US008099829B2

(12) United States Patent
Grove et al.

(10) Patent No.: US 8,099,829 B2
(45) Date of Patent: Jan. 24, 2012

(54) WET TYPE SUCTION CLEANERS

(75) Inventors: Philip Grove, West Midlands (GB); Reuben Proud, Worcester (GB)

(73) Assignee: VAX Limited, Worcestershire (GB)

( * ) Notice: Subject to any disclaimer, the term of this patent is extended or adjusted under 35 U.S.C. 154(b) by 180 days.

(21) Appl. No.: 12/303,198

(22) PCT Filed: May 31, 2007

(86) PCT No.: PCT/GB2007/002003

§ 371 (c)(1),
(2), (4) Date: Dec. 7, 2009

(87) PCT Pub. No.: WO2007/141485

PCT Pub. Date: Dec. 13, 2007

(65) Prior Publication Data

US 2010/0132152 A1 Jun. 3, 2010

(30) Foreign Application Priority Data

Jun. 2, 2006 (GB) ..... 0610850.0

(51) Int. Cl.
*A47L 7/00* (2006.01)

(52) U.S. Cl. ..... 15/347; 15/353; 15/320

(58) Field of Classification Search ..... 15/320, 15/347, 353, 321, 413, 327.2
See application file for complete search history.

(56) References Cited

U.S. PATENT DOCUMENTS 4,114,231 A 9/1978 Nauta
5,259,854 A * 11/1993 Newman ..... 55/320
5,954,863 A 9/1999 Loveless et al.
6,101,669 A * 8/2000 Martin et al. ..... 15/327.2
6,113,663 A * 9/2000 Liu ..... 55/459.1

FOREIGN PATENT DOCUMENTS

| | | |
|---|---|---|
| DE | 3243506 | 5/1984 |
| DE | 9405605 | 6/1994 |
| EP | 1000579 | 5/2000 |
| GB | 2360200 | 9/2001 |
| GB | 2405577 | 3/2005 |
| GB | 2438583 | 12/2007 |
| WO | 94/08502 | 4/1994 |
| WO | 2007/141485 | 12/2007 |

OTHER PUBLICATIONS

PCT/GB2007/002003 International Search Report, 5 pages, Dated Aug. 8, 2007.
GB0610850.0 Search Report, 1 page, Dated Sep. 5, 2006.

* cited by examiner

*Primary Examiner* — Dung Van Nguyen
(74) *Attorney, Agent, or Firm* — Michael Best & Friedrich LLP

(57) ABSTRACT

A wet type suction cleaner comprising a tank (10) having an inlet (22) for suction-induced air flow and an outlet leading to a fan for creating the suction: and a float valve assembly (30) including a housing (32) and a float member movable relative to the housing (32) to cause closure of the outlet; wherein the inlet (22) directs the suction air flow to impinge on a part (40) of the housing (32), and the housing (32) has an opening (54) leading to the outlet which opening (54) is at a part of the housing (32) facing away from the inlet (22), the housing (32) further comprising deflecting means (42) for deflecting impinged matter away from the opening (54).

17 Claims, 4 Drawing Sheets

WET TYPE SUCTION CLEANERS

DESCRIPTION OF INVENTION

This invention relates to suction cleaners (vacuum cleaners) of the so called "wet" type, i.e. able safely to suck up liquids.

Wet type suction cleaners are well known, their ability to suck up liquids being useful for cleaning up spillages. Also, such cleaners may be adapted for floor, e.g. carpet, cleaning by applying liquid to a surface which is to be cleaned and removing it by suction. One very common form of such a cleaner has a body in the form of or including a tank into which matter including liquid can be drawn through a suction hose connected thereto. An electric motor and fan are arranged to draw air out of the tank and lower the pressure therein, so that air and entrained liquid or other matter can be drawn into the tank through the hose. An outlet passage from the tank, leading to the fan, is disposed at an upper part thereof and it is usual to provide in association with such an outlet passage a float valve arrangement so that when the tank is full the outlet passage is closed, thus preventing liquid from being drawn into the fan and expelled from the cleaner through an exhaust passage from the fan. One known form of such a float valve comprises a housing extending downwardly into the tank from the outlet passage therefrom, containing a buoyant element which, as the tank fills, floats upwards within the housing until it reaches the outlet passage and blocks it.

To be able effectively to suck up liquids, wet type vacuum cleaners usually have relatively powerful motors and fans, and the speed of air flow through the fan, tank, suction hose, and whatever cleaning head or fitting is provided at the free end of the hose, is high. Liquid entrained in such air flow should be, as far as possible, separated from the air flow so that it remains within the tank and not expelled through the fan even when the tank is not full. It is known that the suction hose can be connected to the tank at a fitting which incorporates a bend or elbow so that any entrained liquid is separated from the air flow by causing a change in the direction of flow and hence a slowing in the flow speed at the point of entry to the tank. However such provision at the inlet to the tank involves the use of an additional and more complex component, which can be vulnerable to blockage if any large solid items are ingested.

With this in mind, it is broadly the object of the present invention to provide an improvement in the way in which liquid entrained in the machine's air flow is dealt with in the tank.

According to one aspect of the invention, therefore, we provide a wet type suction cleaner comprising a tank having an inlet for suction air flow and an outlet leading to a fan for creating the suction, and a float valve assembly including a housing and a float member movable relative to the housing to cause closure of the outlet, wherein the inlet directs the suction air flow to impinge on a part of the housing, and the housing has an opening leading to the outlet which opening is at a part of the housing facing away from the inlet, the housing further comprising deflecting means for deflecting impinged matter away from the opening.

According to another aspect of the invention, we provide a float valve assembly for fitting in a wet type suction cleaner, comprising a housing having or adapted for co-operation with an outlet port, a float member movable relative to the housing to cause closure of the outlet port, an impingement surface on the housing exterior, facing in a first direction, an opening in the housing exterior, leading to the outlet port, the opening facing in a direction generally opposite to that faced by the impingement surface, and a deflecting means for deflecting matter from the impingement surface away from the opening in the housing.

The housing of the float valve assembly may be generally circular in cross section, of constant or non-constant diameter, or any other appropriate shape; the impingement surface may comprise about half the peripheral extent of the housing and the opening, leading to the interior of the housing and thence to the outlet port, comprise about the opposite half of its peripheral extent. The deflecting means may comprise a wall formation, extending outwardly from the external surface of the housing, between the opening and the impingement surface The tank of the suction cleaner may be substantially circular, or of other shape, in plan view, and the float valve assembly extend downwardly into the tank from a position at or close to the centre of a body fitting on top of the tank (which body contains the electric motor and fan); in this case the outlet port may be at the top end of the housing, either defined by the housing or a part of body of the vacuum cleaner to which the housing connects. The inlet to the tank would be provided in the peripheral wall thereof at a suitable distance above the bottom of the tank, and extend radially, to face the float valve assembly.

With such a configuration of housing and other parts of the suction cleaner, the deflecting means, comprising a rib or wall formation extending outwardly from the external surface of the housing, may extend downwardly from the upper end of the housing, at opposite sides thereof, and the opposite parts of the rib may converge to meet one another at a lower part of the housing, on the side thereof facing the inlet (opposite the opening). Thus the wall formation or rib may, as a whole, be generally C-shaped. The opening in the housing would be provided at an upper part of the housing (above the maximum liquid level which can be expected therein) on the side thereof facing away from the inlet.

The float member may be spherical or cylindrical, guided for movement upwardly and downwardly within the housing by formations, for example inwardly extending ribs, which are oriented upwardly and downwardly of the housing interior.

While it would be within the scope of the invention for the deflector means to be provided by a separate component, or components, secured to or associated with the housing of the float valve assembly, preferably the deflector means is integral with the housing, e.g. as part of a plastics moulding.

The invention will now be described by way of example with reference to the accompanying drawings, of which:

Figure 1:
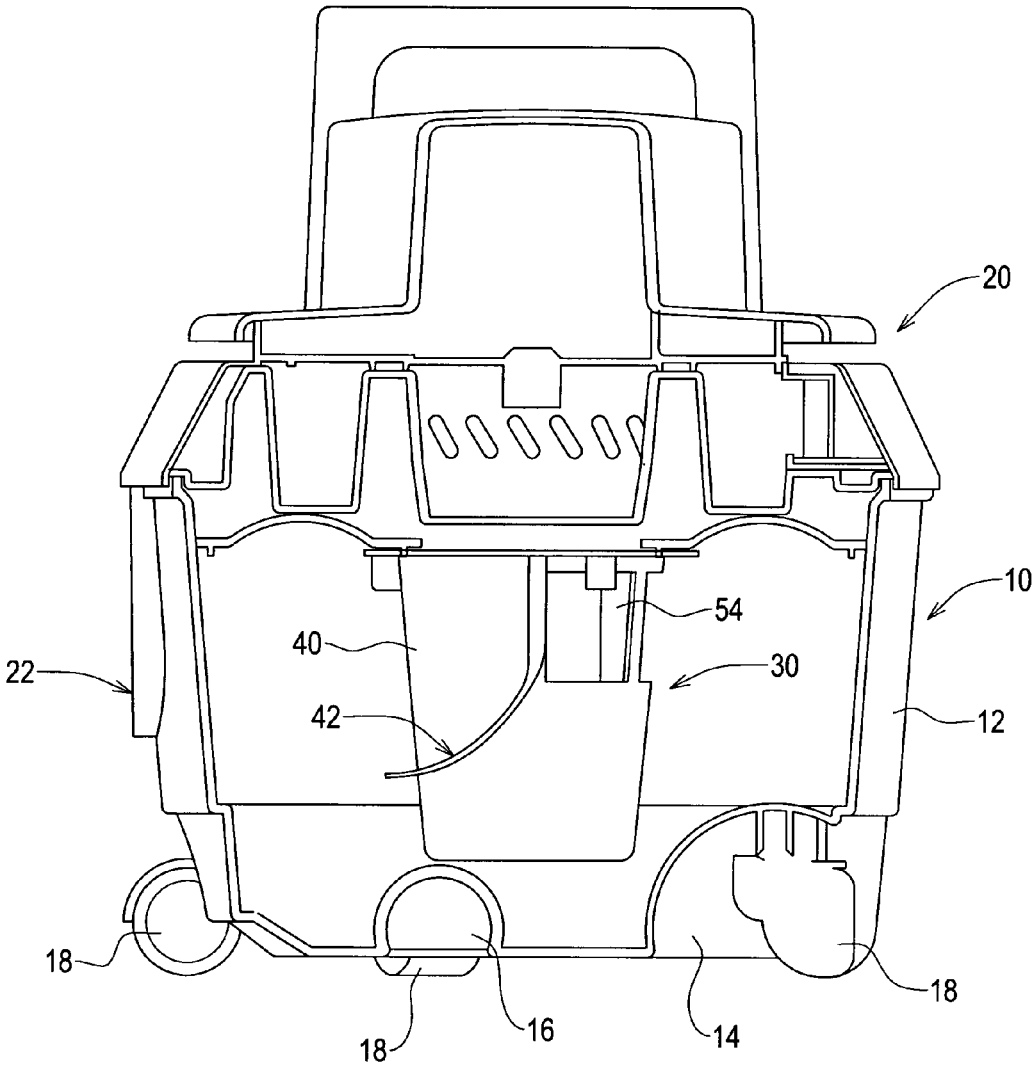
FIG. 1 is a partly-section side elevation of a part of a cleaner in accordance with the invention.
Figure 2:
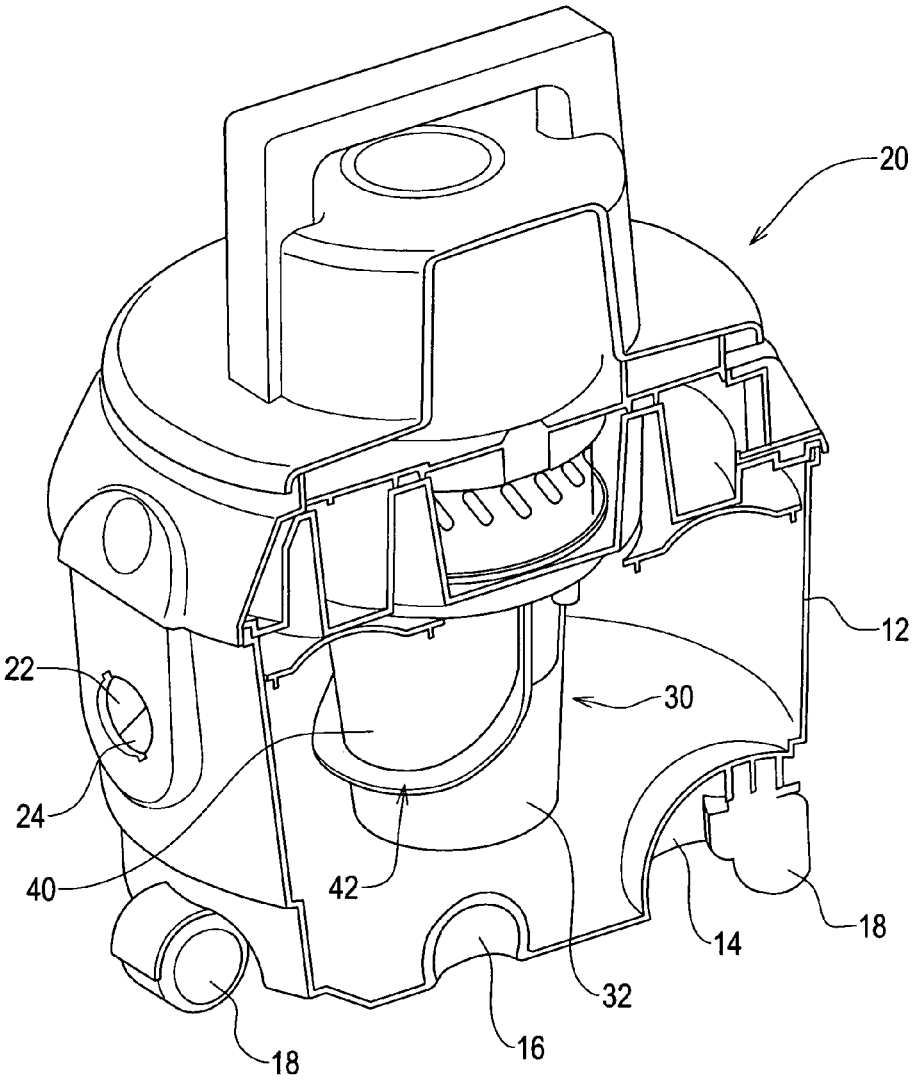
FIG. 2 is a partly broken-away perspective view of the cleaner.

Referring firstly to FIGS. 1 and 2 of the drawings, these illustrate a "wet" type of suction cleaner in accordance with the invention. The cleaner comprises a tank 10 which is of circular shape in plan view, having a peripheral wall 12 which is slightly tapered from top to bottom with a lower wall which is of a complex shape, having a number of peripheral upwardly and radially-inwardly extending recesses, two of which are indicated at 14, 16 in which are disposed respective castors 18 enabling the cleaner to be moved over a floor surface. The top of the tank 10 is closed by a body indicated generally at 20.

The body 20 extends upwardly from the top of the tank 10, and has fitted within it an electric motor and fan assembly by which air can be drawn from the interior of the tank 10 and cause air to be drawn into the tank through an inlet aperture 22 in the peripheral wall 12 of the tank. The inlet 22 has a fitting 24 for bayonet-type connection of a suction hose, not shown. Such provision of an inlet in the peripheral wall of a tank of a wet-type suction cleaner, and the disposition of an electric motor and fan in an upper body part of the cleaner, are well known and hence will not be described in any greater detail herein. Facing the interior of the tank 10, the body 20 has an outlet port which leads to the fan, and from the fan an exhaust passage for air sucked through the tank by the fan leads to the external atmosphere.

Figure 4:
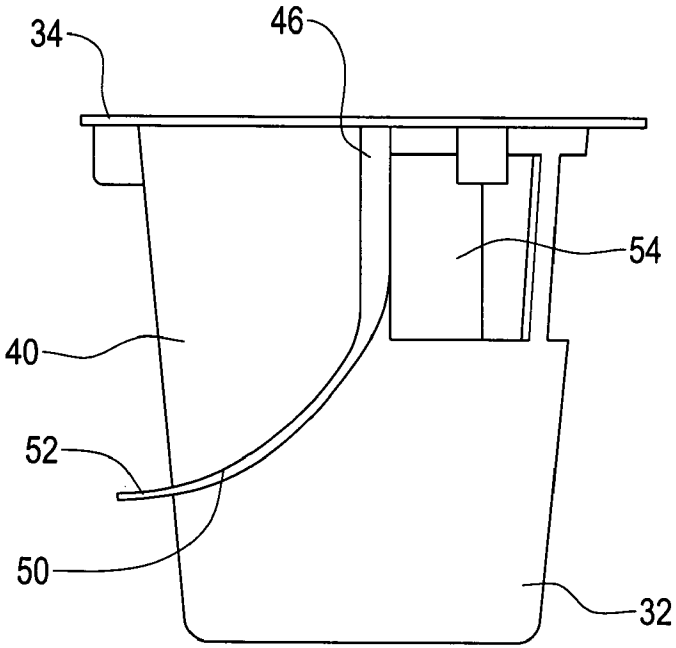
FIGS. 3 and 4 are respectively a front and side elevation of the float valve housing of the cleaner.
Figure 3:
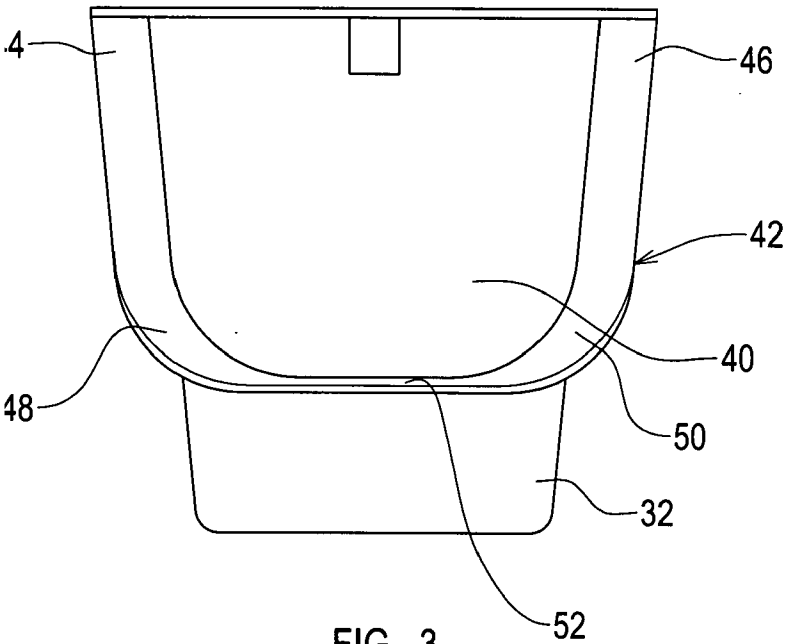
Figure 5:
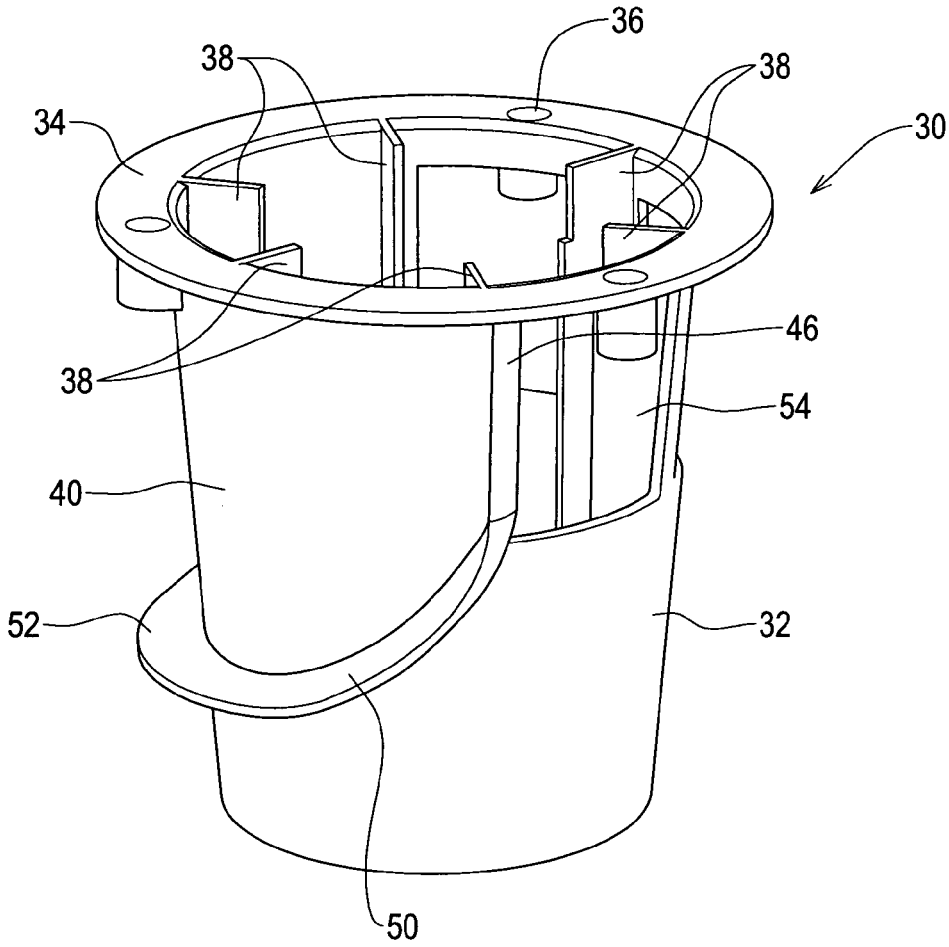
FIG. 5 is a perspective view of the housing.

A float valve assembly indicated generally at 30 extends downwardly within the tank 10 from the centre of the body 20. The float valve assembly comprises a housing whose configuration is shown in greater detail in FIGS. 3 to 5 of the drawings. The housing indicated generally at 32 is of downwardly-tapering part-conical configuration, with a lateral flange 34 at its uppermost end. The flange 34 has three circumferentially spaced apertures one of which is indicated at 36, for receiving fasteners such as bolts or screws by which the housing can be secured to the lower surface of the body 20 around the outlet port therein. The housing is provided with six circumferentially spaced radially inwardly extending guide ribs as indicated at 38, which guide a float member (not shown) for movement upwardly and downwardly within the housing 32. The float member may be spherical, or possibly of cylindrical or some other form, and is arranged to contact and occlude the outlet port when the level of liquid in the tank has reached an acceptable maximum, thereby preventing any further suction of air from the interior of the tank by the fan of the cleaner and thus any further sucking up of liquid. Such provision in wet type suction cleaners is well known.

The housing 32 has, on one side thereof in its upper region, an impingement surface 40 which faces the inlet 22 to the tank. The impingement surface is bounded by a deflector formation 42 in the form of a wall which extends radially outwardly from the exterior surface of the housing 32. Opposite ends 44, 46 of the deflector formation 42 extend downwardly from the peripheral flange 34 at the top of the housing 32, and then the respective parts of the deflector formation are curved at 48, 50 until they extend circumferentially of the housing and meet one another, at 52. Thus the deflector formation as a whole is generally C- or U-shaped.

At the opposite side of the housing 32 from the impingement surface 40, the housing is provided with an opening 54 leading into the interior of the housing, the opening being divided into three parts by two of the ribs 38. These provide for access of air to the interior of the housing 32 whence it is drawn through the outlet port to the fan and is then expelled to the external atmosphere, provided the level of liquid within the tank 10 is not sufficient to cause the float member to rise sufficiently far within the housing 32 to block the outlet port.

The impingement surface 40 of the housing faces the inlet opening 22. If liquid is entrained in the suction air flow entering the tank through the inlet 22, it impinges on the surface 40 which causes drops of the liquid to be separated from the air flow. Such separated liquid runs under gravity down the surface 40, being guided by the deflector formation 42 to the lower part 52 of the formation to fall into the tank. The parts 44, 46 of the deflector formation keep such liquid from being drawn by the suction air flow through the opening 54 to reach the outlet port and fan.

It will be appreciated that modifications may be made, relative to the illustrated embodiment of the invention, while remaining within the broad scope of the invention. For example, the tank of the cleaner may be of other than a circular shape in plan view, as may the float valve assembly, and the latter need not be at the centre of the tank but instead may be nearer one wall post of the tank than another.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A wet type suction cleaner comprising a tank having an inlet for suction-induced air flow and an outlet leading to a fan for creating the suction: and a float valve assembly including a housing and a float member movable relative to the housing to cause closure of the outlet; wherein the inlet directs the suction air flow to impinge on an impingement surface part of the housing, and the housing has an opening leading to the outlet which opening is at a part of the housing facing away from the inlet, the housing further being provided with deflecting means for deflecting impinged matter away from the opening, wherein the deflecting means comprises a wall formation extending outwardly from the external surface of the housing, between the opening and the impingement surface.

2. A suction cleaner according to claim 1 wherein the impingement surface comprises about half the peripheral extent of the housing.

3. A suction cleaner according to claim 2 wherein the opening comprises about the opposite half of the peripheral extent of the housing.

4. A suction cleaner according to claim 1, wherein the housing is generally circular in cross section.

5. A suction cleaner according to claim 1, wherein the float valve assembly extends downwardly into the tank, at or close to the centre thereof in plan view, from a body fitting on top of the tank.

6. A suction cleaner according to claim 5 wherein the tank is substantially circular in plan view.

7. A suction cleaner according to claim 6 wherein the inlet to the tank is provided in a peripheral wall thereof, spaced above the bottom of the tank and extending substantially radially to face the float valve assembly.

8. A suction cleaner according to claim 1, wherein the deflecting means has opposite end portions extending downwardly from an upper end of the housing at opposite sides thereof, opposite parts of the deflecting means converging to meet one another at a lower part of the housing opposite the opening.

9. A suction cleaner according to claim 1, wherein the float member is guided for movement upwardly and downwardly within the housing.

10. A suction cleaner according to claim 9 wherein the float member is guided by inwardly extending ribs oriented upwardly and downwardly of the housing interior.

11. A float valve assembly for fitting in a wet-type suction cleaner, comprising a housing having or adapted for co-operation with an outlet port, a float member movable relative to the housing to cause closure of the outlet port, an impingement surface on the housing exterior and facing in a first direction, an opening in the housing exterior, leading to the outlet port, the opening facing in a direction generally opposite to that faced by the impingement surface, and a deflecting means for deflecting matter from the impingement surface away from the opening in the housing, wherein the deflecting means comprises a wall formation extending outwardly from the external surface of the housing, between the opening and the impingement surface.

12. A float valve assembly according to claim 11, wherein the impingement surface comprises about half the peripheral extent of the housing.

13. A suction cleaner or float valve assembly according to claim 12, wherein the opening comprises about the opposite half of the peripheral extent of the housing.

14. A suction cleaner or float valve assembly according to claim 11, wherein the housing is generally circular in cross section.

15. A float valve assembly according to claim 11, wherein the deflecting means has opposite end portions extending downwardly from an upper end of the housing at opposite sides thereof, opposite parts of the deflecting means converging to meet one another at a lower part of the housing opposite the opening.

16. A float valve assembly according to claim 11, wherein the float member is guided for movement upwardly and downwardly within the housing.

17. A float valve assembly according to claim 16, wherein the float member is guided by inwardly extending ribs oriented upwardly and downwardly of the housing interior.

* * * * *